US011364531B2

(12) United States Patent
Xu et al.

(10) Patent No.: US 11,364,531 B2
(45) Date of Patent: Jun. 21, 2022

(54) METAL WORKPIECE INDENTATION MARKING DEVICE

(71) Applicant: NANJING UNIVERSITY OF POSTS AND TELECOMMUNICATIONS, Nanjing (CN)

(72) Inventors: Fengyu Xu, Nanjing (CN); Sen Yang, Nanjing (CN); Fan Lv, Nanjing (CN); Guoping Jiang, Nanjing (CN); Jingjin Shen, Nanjing (CN)

(73) Assignee: NANJING UNIVERSITY OF POSTS AND TELECOMMUNICATIONS, Nanjing (CN)

( * ) Notice: Subject to any disclaimer, the term of this patent is extended or adjusted under 35 U.S.C. 154(b) by 277 days.

(21) Appl. No.: 16/759,128

(22) PCT Filed: Sep. 10, 2019

(86) PCT No.: PCT/CN2019/105048
§ 371 (c)(1),
(2) Date: Apr. 24, 2020

(87) PCT Pub. No.: WO2020/098353
PCT Pub. Date: May 22, 2020

(65) Prior Publication Data

US 2021/0205870 A1 Jul. 8, 2021

(30) Foreign Application Priority Data

Nov. 15, 2018 (CN) ..... 201811357111.2

(51) Int. Cl.
*B44B 5/00* (2006.01)
*B21C 51/00* (2006.01)
(Continued)

(52) U.S. Cl.
CPC ..... *B21D 22/02* (2013.01); *B21C 51/005* (2013.01); *B44B 5/00* (2013.01); *B44B 5/0057* (2013.01); *B44B 5/0076* (2013.01); *B44C 1/24* (2013.01)

(58) Field of Classification Search
CPC ..... B44B 5/0057; B44B 5/0076; B44B 5/022; B44B 5/026; B44B 5/0052; B44B 5/0019;
(Continued)

(56) References Cited

U.S. PATENT DOCUMENTS 1,341,021 A * 5/1920 Robbins ..... B41K 3/08 101/110
1,407,769 A * 2/1922 Premo ..... B44B 5/0076 72/404
(Continued)

FOREIGN PATENT DOCUMENTS

CN 2649340 Y * 10/2004
CN 205344160 U * 6/2016
DE 1815412 A1 * 7/1969

*Primary Examiner* — Gregory D Swiatocha
(74) *Attorney, Agent, or Firm* — CBM Patent Consulting, LLC

(57) ABSTRACT

A metal workpiece indentation marking device, comprising a frame, a striking head, an automatic marking die, a gripper and a two-dimensional moving mechanism, wherein the top of the striking head is connected to the frame; the striking head can move up and down; the automatic marking die is fixedly disposed at the bottom of the striking head; a clamping jaw for clamping a metal workpiece is disposed at the top of the gripper; the gripper can move back and forth or left and right under the action of the two-dimensional moving mechanism, such that a position to be marked at the top of the metal workpiece can be located under the automatic marking die.

7 Claims, 7 Drawing Sheets

(51) Int. Cl.
*B21D 22/02* (2006.01)
*B44C 1/24* (2006.01)

(58) Field of Classification Search
CPC .... B44C 1/24; B41K 3/08; B41K 3/10; B41K 3/105
See application file for complete search history.

(56) References Cited

U.S. PATENT DOCUMENTS

| | | | | |
|---|---|---|---|---|
| 2,232,528 | A * | 2/1941 | Hoffmann | B44B 5/0076 101/110 |
| 3,015,265 | A * | 1/1962 | Gmeiner | B41J 1/48 101/93.21 |
| 4,084,507 | A * | 4/1978 | Sato | B41K 5/02 101/110 |
| 9,403,354 | B2 * | 8/2016 | Wursch | B41F 13/0008 |
| 2005/0022680 | A1 * | 2/2005 | Plattet | B44B 5/0076 101/3.1 |
| 2008/0314220 | A1 * | 12/2008 | Ferry | B44B 5/026 83/684 |
| 2011/0308294 | A1 * | 12/2011 | Erlenmaier | B21D 28/20 72/429 |

* cited by examiner

METAL WORKPIECE INDENTATION MARKING DEVICE

TECHNICAL FIELD

The present invention relates to a marking device, in particular to a metal workpiece indentation marking device.

BACKGROUND

At present, a metal workpiece is marked mainly with the methods such as laser marking, carving, indentation marking and the like. However, the above marking methods all have the following defects, and need to be improved.

1. The laser marking method and the carving method have a high automation degree, and are often used in an automatic production line. However, the trace left on a metal surface is shallow; on one hand, such a metal surface is not aesthetic enough, on the other hand, more importantly, the laser-marked or carved mark would often be covered in a subsequent painting process, which brings difficulties to actual production.

2. The indentation marking method performs stamping via a marking punch; therefore, the surface is aesthetically pleasing and the indentation is deep. However, characters are manually arranged and combined at present. Although the effect of the marked indentation can satisfy requirements, the automation degree is low. Furthermore, a misoperation leading to a character arrangement error often occurs during manual character arrangement.

SUMMARY OF THE INVENTION

The technical problem to be solved by the present invention is to provide a metal workpiece indentation marking device to overcome the above defects in the prior art. The metal workpiece indentation marking device can realize fully automatic character arrangement without manual participation, has a high efficiency, and can imprint a plurality of characters in one time stamping.

To solve the above technical problem, the present invention adopts the following technical solution: a metal workpiece indentation marking device, comprising a frame, a striking head, an automatic marking die, a gripper and a two-dimensional moving mechanism, wherein the top of the striking head is connected to the frame; the striking head can move up and down; the automatic marking die is fixedly disposed at the bottom of the striking head.

A clamping jaw for clamping a metal workpiece is disposed at the top of the gripper; the gripper can move back and forth or left and right under the action of the two-dimensional moving mechanism, such that a position to be marked at the top of the metal workpiece can be located under the automatic marking die.

The automatic marking die comprises a bracket, a character switching mechanism, a core shaft and character disks.

The two ends of the core shaft is fixedly connected to the bracket; the character disks are axially sleeved in parallel on the periphery of the core shaft; a plurality of protruding characters are circumferentially distributed on the periphery of each character disk; and each character disk can rotate under the action of the character switching mechanism.

The automatic marking die further comprises a scale locking mechanism; the scale locking mechanism comprises a spring and a steel ball.

The core shaft is provided with a circumferential groove at the positions where each character disk is sleeved; a plurality of circular pits are circumferentially uniformly distributed in each circumferential groove; strip-shaped slots in the same number as the circular pits are radially distributed on an inner annular surface of each character disk; each strip-shaped slot is internally provided with a spring and a steel ball; the spring is in a compressed state, and can tightly compress the steel ball in the circular pit.

A plurality of axial grooves are uniformly distributed on the core shaft; and each axial groove is in parallel with an axis of the core shaft.

A plurality of gear teeth are uniformly distributed on an outer annular surface of each character disk; and the characters are distributed on the crests of the gear teeth.

A null character is disposed on at least one gear tooth of each character disk.

The character switching mechanism comprises a transmission bar, a rotation driving device, a rectilinear motion driving device and a poking device, wherein the transmission bar is located on the outer sides of the character disks, and is in parallel with the core shaft; the two ends of the transmission bar respectively penetrate through corresponding bracket plate surfaces, wherein a penetrating end on one side is connected to the rotation driving device, and a penetrating end on the other side is connected to the rectilinear motion driving device; the rotation driving device is configured to drive the transmission bar to rotate; the rectilinear motion driving device is configured to drive the transmission bar to do rectilinear motion; one side of the toggling device is fixedly connected to the transmission bar, and the other side can toggle the corresponding character disk to rotate.

The toggling device is a shift fork or a ratchet.

The two-dimensional moving mechanism comprises a cross beam and a base; the base is connected to the frame; the cross beam is in parallel with the core shaft, is slidably connected to a top surface of the base, and can glide in a direction perpendicular to the core shaft; the bottom of the gripper is slidably connected to the top of the cross beam; and the gripper can glide in a direction in parallel with the core shaft.

The number of the gripper is two; and the base is further provided with an iron pad between the two grippers.

The present invention has the following beneficial effects: in the present invention, the gripper grips the metal workpiece, and moves to complete the marking operation at different positions; a plurality of characters can be marked under the cooperation of multiple stamping actions of the striking head; the scale locking mechanism can lock the core shaft and the character disks; the character switching mechanism can unlock the core shaft and the character disk, and can automatically switch required characters in each character disk.

Wherein

10, frame; 20, striking head;

30, automatic marking die;

31, character switching mechanism; 311, transmission bar; 312, rotation driving device; 313, rectilinear motion driving device; 314, shift fork;

32, core shaft; 321, axial groove; 322, circumferential groove; 323, circular pit;

33, character disk; 331, circular hole; 332, gear tooth; 333, character;

34, scale locking mechanism; 341, strip-shaped slot; 342, spring; 343, steel ball;

35, bracket;

40, metal workpiece;

50, gripper; 51, clamping jaw;

60, cross beam; 70, base; 71, iron pad.

DETAILED DESCRIPTION OF THE PREFERRED EMBODIMENTS

The present invention will be further described in detail in combination with the drawings and specific preferred embodiments.

Figure 1:
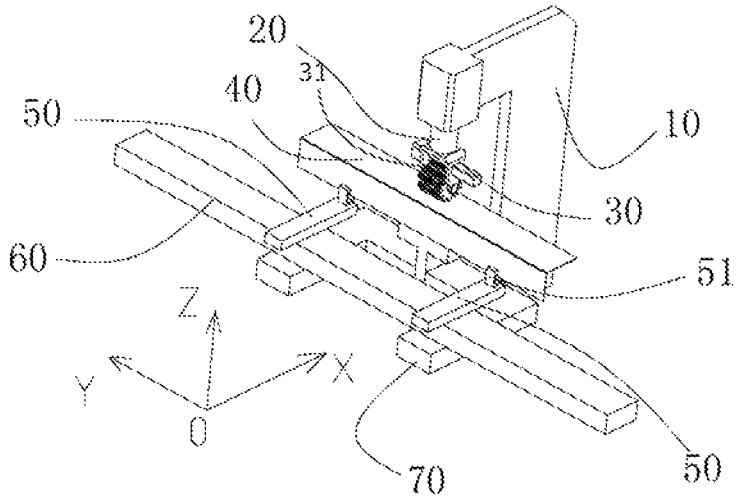
FIG. 1 is a stereoscopic structure schematic view of the metal workpiece indentation marking device according to the present invention.
Figure 2:
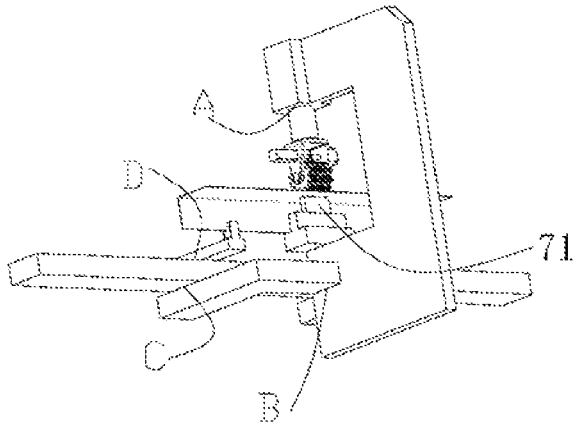
FIG. 2 is a schematic view of a movable connection point on the metal workpiece indentation marking device according to the present invention.

As shown in FIGS. 1 and 2, a metal workpiece indentation marking device, comprising a frame 10, a striking head 20, an automatic marking die 30, a gripper 50 and a two-dimensional moving mechanism.

The top of the striking head is connected, preferably movably connected to the frame, preferably the position A as shown in FIG. 2; the striking head can move up and down, that is, can do rectilinear motion in the Z direction under the action of a driving device; and the automatic marking die is fixedly disposed at the bottom of the striking head.

The two-dimensional moving mechanism preferably comprises a cross beam 60 and a base 70.

The base is preferably in a U-shape, and is fixedly connected to the bottom of the frame, preferably the position B as shown in FIG. 2.

The cross beam is in parallel with a core shaft or a gripped metal workpiece 40; the direction of the cross beam is the Y direction, and the direction perpendicular to the cross beam is the X direction; the cross beam is slidably connected to the top of the base, preferably the position C as shown in FIG. 2, and can do rectilinear motion in the X direction, that is, can glide in the direction perpendicular to the core shaft.

The number of the gripper is preferably two; the bottom of each gripper is slidably connected to the top of the cross beam, preferably the position D as shown in FIG. 2; and each gripper can glide in a direction in parallel with the core shaft (that is, the Y direction).

The gripper grips the metal workpiece, and moves to complete the marking operation at different positions; a plurality of characters can be marked under the cooperation of multiple stamping actions of the striking head.

The metal workpiece is carried under the automatic marking die; and the striking head acts to complete marking.

The two-dimensional moving mechanism can also adopt other structural forms in the prior art, which is in the protection scope of the present application.

A clamping jaw 51 for clamping the metal workpiece is disposed at the top of the gripper; the gripper can move back and forth or left and right under the action of the two-dimensional moving mechanism, such that a position to be marked at the top of the metal workpiece can be located under the automatic marking die.

The base is further preferably provided with an iron pad 71 between the two grippers; and the iron pad is configured to support the middle of the metal workpiece.

Figure 3:
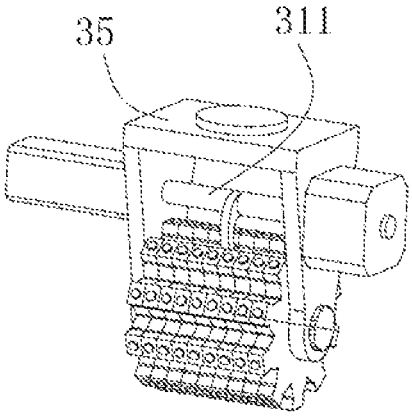
FIG. 3 shows a stereoscopic structure schematic view of the automatic marking die.
Figure 4:
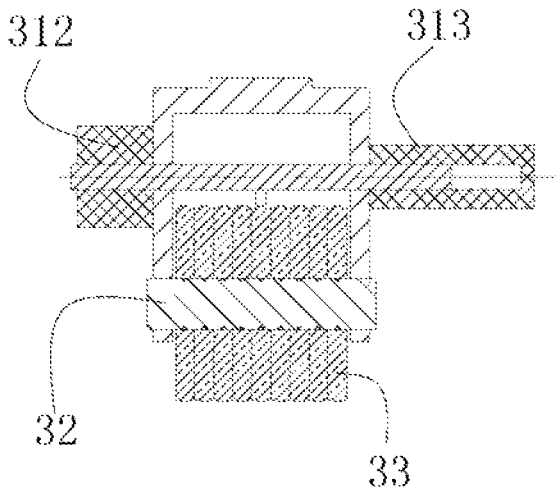
FIG. 4 shows a sectional view of the automatic marking die.

As shown in FIGS. 3 and 4, the automatic marking die comprises a bracket 35, a character switching mechanism 31, a core shaft 32, character disks 33 and a scale locking mechanism 34.

The bracket preferably comprises a top plate, and bracket plates fixed on the two sides of the top plate, wherein the top of the top plate is fixedly connected to the bottom of the striking head.

Figure 10:
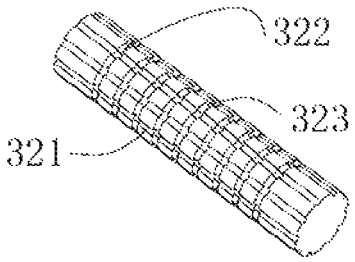
FIG. 10 shows a perspective view of the core shaft.
Figure 11:
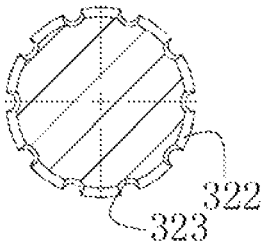
FIG. 11 shows a sectional view of the core shaft.

The two ends of the core shaft is fixedly connected to the two bracket plates; as shown in FIGS. 10 and 11, a plurality of axial grooves 321 are uniformly distributed on the core shaft; and each axial groove is in parallel with an axis of the core shaft. The configuration of the axial grooves facilitates the mounting of the character disks.

A plurality of circumferential grooves 322 are axially uniformly distributed on the core shaft; each circumferential groove is perpendicular to the axis of the core shaft; and a plurality of circular pits 323 are circumferentially uniformly distributed in each circumferential groove.

The character disks are axially sleeved in parallel on the periphery of the core shaft; the number of the character disks is equal to the number of the circumferential grooves; a central shaft hole 331 is disposed in the center of each character disk; the inner diameter of the central shaft holes is greater than the outer diameter of the circumferential grooves; and the positions of the character disks correspond to the positions of the circumferential grooves.

Figure 5:
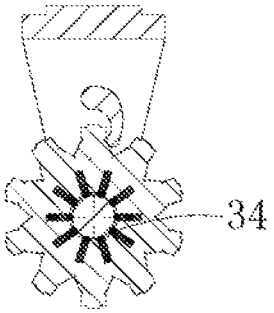
FIG. 5 shows a structural schematic view of the scale locking mechanism.
Figure 6:
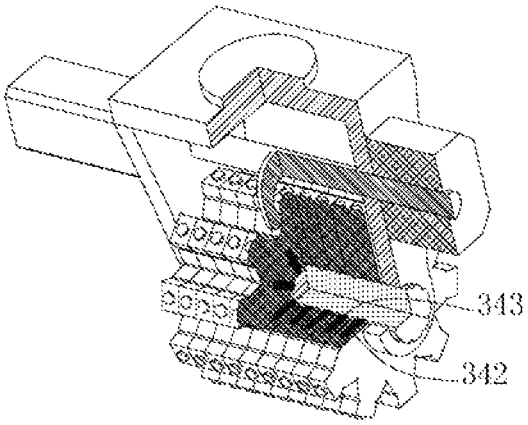
FIG. 6 shows a half-sectional view of a connection of the character disk and the core shaft.

The character disks are locked and limited in the circumferential grooves on the core shaft via the scale locking mechanism as shown in FIGS. 5 and 6.

Figure 7:
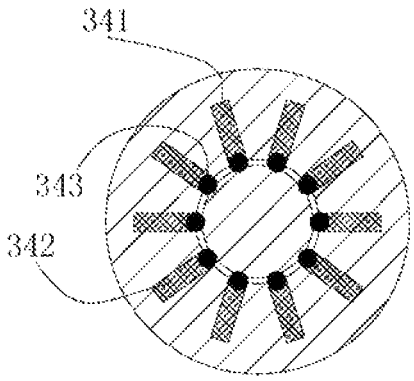
FIG. 7 shows a structural schematic view of the scale locking mechanism when the scale locking mechanism locks the character disks.

As shown in FIG. 7, the scale locking mechanism comprises a spring 342 and a steel ball 343.

Strip-shaped slots 341 in the same number as the circular pits are radially distributed on an inner annular surface of each character disk; the strip-shaped slots are preferably in a cylindrical shape; and the axis of each cylindrical slot points to the center of circle of the corresponding circumferential groove.

Each strip-shaped slot is internally provided with a spring and a steel ball; the spring is in a compressed state, and can tightly compress the steel ball in the circular pit.

Figure 8:
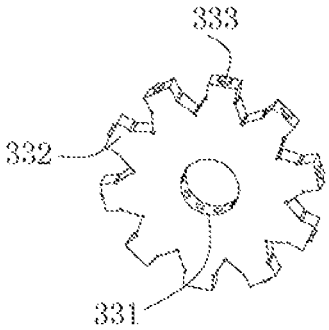
FIG. 8 shows a structural schematic view of the character disk.
Figure 9:
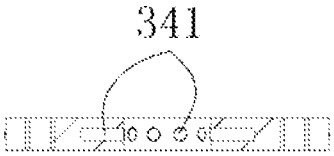
FIG. 9 shows a sectional view of the character disk.

A plurality of protruding characters 333 are circumferentially distributed on the periphery of each character disk. Preferably, as shown in FIGS. 8 and 9, the character disks are in a gear teeth shape, that is, a plurality of gear teeth 332 are uniformly distributed on an outer annular surface of each character disk; and the characters are distributed on the crests of the gear teeth.

Further, a null character is disposed on at least one gear tooth of each character disk, so as to stamp different "bits" of characters.

Each character disk can rotate under the action of the character switching mechanism.

The character switching mechanism comprises a transmission bar 311, a rotation driving device 312, a rectilinear motion driving device 313 and a toggling device.

The transmission bar is located on the outer sides of the character disks, and is in parallel with the core shaft; the two ends of the transmission bar respectively penetrate through corresponding bracket plate surfaces, wherein a penetrating end on one side is connected to the rotation driving device, and a penetrating end on the other side is connected to the rectilinear motion driving device.

The rotation driving device is configured to drive the transmission bar to rotate; the rectilinear motion driving device is configured to drive the transmission bar to do rectilinear motion; the toggling device is axially engaged with different character disks, so as to switch different bits of characters.

One side of the toggling device is fixedly connected to the transmission bar, and the other side can toggle the corresponding character disk to rotate.

Figure 12:
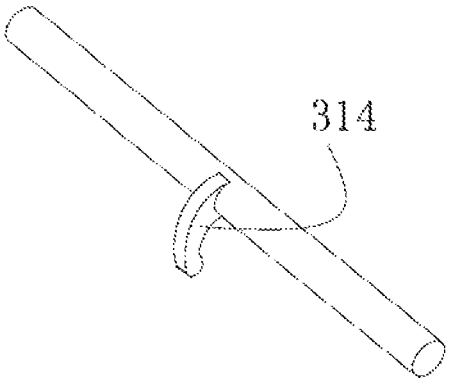
FIG. 12 shows a structural schematic view of the transmission bar and the shift fork.

The toggling device is preferably a shift fork 314 or a ratchet as shown in FIG. 12. The scale locking mechanism is configured to fix the positions of the character disks, can unlock the character disks under the driving of the shift fork, and can rotate a scale plate to switch characters.

The preferred embodiments of the present invention are described in detail as above. However, the present invention is not limited to the specific details in the above embodiments. Various equivalent substitutions can be made to the technical solution of the present invention in the technical concept scope of the present invention, and the equivalent substitutions are all concluded in the protection scope of the present invention.

What is claimed is:

1. A metal workpiece indentation marking device comprising: a frame, a striking head, an automatic marking die, at least one gripper and a two-dimensional moving mechanism capable of moving in two dimensions;

the top of the striking head is connected to the frame; the striking head can move up and down; the automatic marking die is fixedly disposed at the bottom of the striking head;

a clamping jaw for clamping a metal workpiece is disposed at the top of the least one gripper; the least one gripper can move back and forth or left and right under the action of the two-dimensional moving mechanism, such that a position to be marked at the top of the metal workpiece can be located under the automatic marking die;

the automatic marking die comprises a bracket, a charactcr switching mechanism, a core shaft and character disks;

the two ends of the core shaft are fixedly connected to the bracket; the character disks are axially sleeved in parallel on the periphery of the core shaft; a plurality of protruding characters are circumferentially distributed on the periphery of each character disk; and each character disk can rotate under the action of the character switching mechanism;

wherein the automatic marking die further comprises an index lock; the index lock comprises a spring and a steel ball;

the core shaft is provided with a circumferential groove at the positions where each character disk is sleeved; a plurality of circular pits are circumferentially uniformly distributed in each circumferential groove; slots in the same number as the circular pits are radially distributed on an inner annular surface of each character disk; each slot is internally provided with the spring and the steel ball; the spring is in a compressed state, and can compress the steel ball in the circular pit.

2. The metal workpiece indentation marking device according to claim 1, wherein a plurality of axial grooves are uniformly distributed on the core shaft; and each axial groove is parallel to an axis of the core shaft.

3. The metal workpiece indentation marking device according to claim 1, wherein a plurality of gear teeth are uniformly distributed on an outer annular surface of each character disk; and the characters are distributed on the crests of the gear teeth.

4. The metal workpiece indentation marking device according to claim 1, wherein the character switching mechanism comprises a transmission bar, a rotation driving device, a rectilinear motion driving device and a toggling device; the transmission bar is located on the outer sides of the character disks, and is parallel to the core shaft; the two ends of the transmission bar respectively penetrate through corresponding bracket plate surfaces, wherein a penetrating end on one side is connected to the rotation driving device, and a penetrating end on the other side is connected to the rectilinear motion driving device; the rotation driving device is configured to drive the transmission bar to rotate; the rectilinear motion driving device is configured to drive the transmission bar to do rectilinear motion; one side of the toggling device is fixedly connected to the transmission bar, and the other side can toggle the corresponding character disk to rotate.

5. The metal workpiece indentation marking device according to claim 4, wherein the toggling device is a shift fork or a ratchet.

6. The metal workpiece indentation marking device according to claim 1, wherein the two-dimensional moving mechanism comprises a cross beam and a base; the base is connected to the frame; the cross beam is parallel to the core shaft, is slidably connected to a top surface of the base, and can glide in a direction perpendicular to the core shaft; the bottom of the at least one gripper is slidably connected to the top of the cross beam; and the at least one gripper can glide in a direction parallel to the core shaft.

7. The metal workpiece indentation marking device according to claim 6, wherein two grippers are provided; and the base is further provided with an iron pad between the two grippers.

* * * * *